US008317191B2

(12) United States Patent
deJong et al.

(10) Patent No.: US 8,317,191 B2
(45) Date of Patent: Nov. 27, 2012

(54) SHEET REGISTRATION USING MULTIPLE ELONGATED SENSORS

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 50 days.

(21) Appl. No.: 12/577,987

(22) Filed: Oct. 13, 2009

(65) Prior Publication Data

US 2011/0084441 A1 Apr. 14, 2011

(51) Int. Cl.
*B65H 7/02* (2006.01)

(52) U.S. Cl. ..... 271/227; 271/228

(58) Field of Classification Search ..... 271/226–228, 271/265.02

See application file for complete search history.

(56) References Cited

U.S. PATENT DOCUMENTS

| | | | | |
|---|---|---|---|---|
| 4,417,150 | A | 11/1983 | Moran | |
| 4,506,969 | A | 3/1985 | Baker | |
| 4,511,242 | A | 4/1985 | Ashbee | |
| 4,890,924 | A | 1/1990 | Beckstein | |
| 4,971,304 | A | 11/1990 | Lofthus | |
| 5,078,384 | A | 1/1992 | Moore | |
| 5,094,442 | A | 3/1992 | Kamprath et al. | |
| 5,156,391 | A | 10/1992 | Roller | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| 5,354,992 | A * | 10/1994 | Thompson et al. | 250/548 |
| 5,678,159 | A | 10/1997 | Williams et al. | |
| 5,697,608 | A | 12/1997 | Castelli et al. | |
| 5,794,176 | A | 8/1998 | Milillo | |
| 5,887,996 | A | 3/1999 | Castelli et al. | |
| 6,032,004 | A | 2/2000 | Mirabella, Jr. et al. | |
| 6,173,952 | B1 | 1/2001 | Richards et al. | |
| 6,335,511 | B1 | 1/2002 | Rothermel | |
| 6,515,917 | B2 | 2/2003 | Lamb et al. | |
| 6,575,458 | B2 | 6/2003 | Williams et al. | |
| 6,805,509 | B2 * | 10/2004 | Ahn | 400/709 |
| 7,500,668 | B2 | 3/2009 | DeJong et al. | |
| 2004/0046313 | A1 | 3/2004 | Herrmann et al. | |
| 2006/0197038 | A1 * | 9/2006 | Park et al. | 250/559.37 |

* cited by examiner

*Primary Examiner* — Michael McCullough
(74) *Attorney, Agent, or Firm* — Gibb & Riley, LLC

(57) ABSTRACT

A method and system have a media path having moving devices that move a media sheet in a processing direction. At least two elongated sensors within the media path are positioned diagonally relative to the processing direction. The media sheet has two lateral sides, a leading edge, and a trailing edge. A registration controller is operatively connected to the media path and to the elongated sensors. Each of the elongated sensors simultaneously identifies: a location of one of the lateral sides of the media sheet, such that a combination of the elongated sensors simultaneously outputs at least two lateral measures of locations of the lateral sides of the media sheet; and at least one measure leading edge or at least one measure of the trailing edge of the media sheet.

19 Claims, 4 Drawing Sheets

SHEET REGISTRATION USING MULTIPLE ELONGATED SENSORS

BACKGROUND AND SUMMARY

Embodiments herein generally relate to printing devices and other machines that utilize media paths to feed and register media sheets and more particularly to a registration system that utilizes multiple diagonal elongated sensors to determine the skew and position of the media sheet.

Sheet transport and registration systems often require sheet position and/or sheet dimension measurements. For example, sheet registration systems measure sheet position for use by a sheet controller to position the sheet to a datum. Sheet position is commonly measured in three degrees of freedom, a.k.a. process (lead edge), lateral (side edge) and skew (angle). This requires multiple sensors. For second side imaging, sheet trailing edge sensing may also be used. This increases the number of sensors at a substantial expense.

The embodiments herein describe methods and devices in sheet registration systems which use two or more array sensors to measure sheet position in three degrees of freedom, process position, lateral position and skew. A sensor may measure two or more different edges of the sheet simultaneously. This reduces the overall number of sensors resulting in substantial cost saving.

Disclosed herein is an apparatus, such as a printing apparatus (e.g., an electrostatic or xerographic machine) that has a media path and alignment devices (moving devices, such as rollers, belts, air movement devices, etc). The alignment devices move a media sheet in a processing direction of the media path. At least two elongated sensors are positioned adjacent the alignment devices within the media path. The elongated sensors are positioned diagonally relative to the processing direction of the media path.

The media sheet is generally rectangular and includes a front side and a backside and two lateral sides, a leading edge, and a trailing edge. A marking device is positioned adjacent the alignment devices within the media path. The marking device prints markings on the media sheet.

The elongated sensors each comprise an array of light sensitive pixels. The elongated sensors are positioned, relative to the media path, such that the elongated sensors simultaneously detect one of the lateral sides, and either the leading edge or the trailing edge of the media sheet. The elongated sensors are positioned at a diagonal angle with respect to the media path and the processing direction. In other words, the elongated sensors are at an angle other than parallel to, and other than perpendicular to the sheet processing direction.

Thus, each of the elongated sensors simultaneously identifies a location of one of the lateral sides of the media sheet, and either the leading edge or the trailing edge of the media sheet. Thus, a combination of the elongated sensors simultaneously outputs at least two lateral measures of locations of the lateral sides of the media sheet (each sensor outputs one position of one lateral side of the media sheet and the two combined sensors output two lateral measures). Also, the combination of the elongated sensors simultaneously outputs at least one leading edge measure of a position of the leading edge of the media sheet and/or at least one trailing edge measure of a position of the trailing edge of the media sheet (each of the sensors detects either the leading edge or the trailing edge and the two combined sensors output one or both measures).

A registration controller is operatively connected to (directly or indirectly connected to) the media path and to the elongated sensors. The registration controller utilizes at least three simultaneous measures (comprising the two lateral measures; and the leading edge measure and/or the trailing edge measure) to determine the skew and position of the media sheet. Skew can be determined from the difference of the two lateral measurements. In addition, lateral position measurement (for lateral alignment) is measured by either sensor or a weighted average. Process position (for process alignment) is measured by sensors. The choice depends on whether lead edge or trail edge alignment is to be achieved. Skew can be determined from the difference of the two lead edge measurements. Process and lateral measurement can use either sensor or a weighted average. The registration controller calculates a registration correction factor based upon the skew and alters the actions of the alignment devices based on the correction factor to correct the skew. The registration controller also calculates a registration correction action based on the position (lateral and process direction) of the sheet and alters the action of the alignment devices to correct for the position.

Embodiments herein also comprise method embodiments. For example, one method embodiment moves the media sheet along the media path in the processing direction using moving devices within the media path. The method uses at least two elongated sensors within the media path positioned diagonally relative to the processing direction to simultaneously identify a location of at least one of the lateral sides of the media sheet and the leading edge and/or the trailing edge of the media sheet. Again, the combination of the elongated sensors simultaneously outputs at least two lateral measures of locations of the lateral sides of the media sheet and outputs at least one leading edge measure of a position of the leading edge of the media sheet and/or at least one trailing edge measure of a position of the trailing edge of the media sheet.

Utilizing the lateral measures and at least one of the leading edge measure(s) and/or the trailing edge measure(s), the registration controller determines the skew and position of the media sheet using a registration controller. Skew can be determined from the difference of the two lateral measurements. In addition, lateral position measurement (for lateral alignment) is measured by either sensor or a weighted average. Process position (for process alignment is measured by sensors. The choice depends on whether lead edge or trail edge alignment is to be achieved. Skew can be determined from the difference of the two lead edge measurements. Process and lateral measurement can use either sensor or a weighted average. The registration controller also calculates the registration correction factor based upon the skew, and alters actions of the moving devices based on the correction factor to correct the skew. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

While the following embodiments are described hereafter with reference to a printing apparatus, it should be understood that embodiments herein are not strictly limited to printers. Rather, any device that feed and aligns sheets of media is contemplated by this disclosure.

Figure 1:
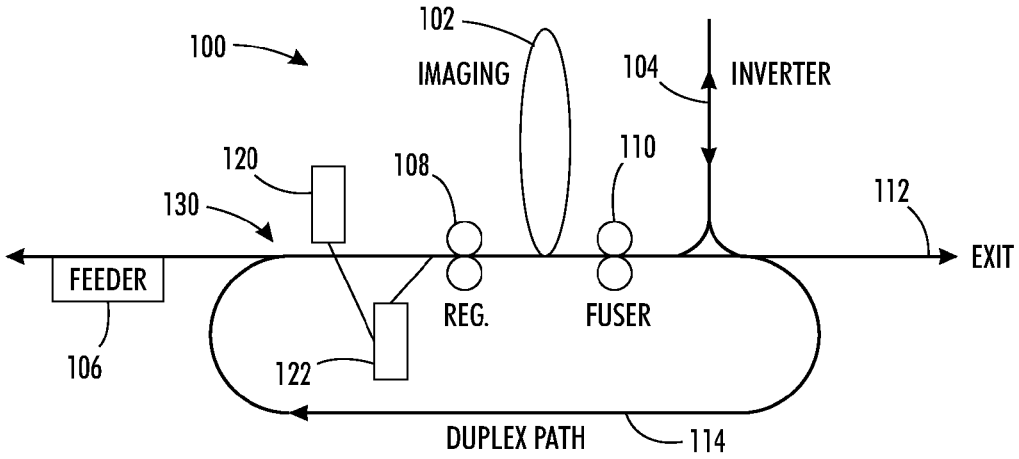
FIG. 1 is a side-view schematic representation of an apparatus according to embodiments herein having a media path.

As mentioned above, embodiments herein relate to the registration or alignment of media sheets within the media path. Such a media path operating within a printing apparatus 130 (e.g., an electrostatic or xerographic machine) is illustrated in FIG. 1. More specifically, a duplex media sheet path 130 is illustrated in FIG. 1. Media sheets are fed from a feeder 106, and registered with media sheet registration nips 108 before receiving the image from a marking device 102.

The image is then fused onto the media by the fuser 110 and the sheet may or may not be inverted by the inverter 104 before it passes through the exit 112. Conventional marking devices, fusers, media sheet paths, etc., are discussed at length in U.S. Pat. No. 6,032,004, the complete disclosure of which is fully incorporated herein by reference. For duplex printing, the sheet is inverted and routed through the duplex path to present the second side of the media sheet to the imaging device. Note that inversion may also take place in the duplex path. Inversion transposes the lead edge (LE) and trail edge (TE).

Embodiments herein also include alignment sensors 120 that are shown as being located adjacent the sheet registration nips 108; however, this location is merely one example and the alignment sensors 120 could be located at any location of the sheet path 130 that allows the sheet to be observed before the sheet enters the sheet registration nips 108. A registration controller 122 is operatively connected to (directly or indirectly connected to) among other items, the alignment sensors 120 and the media sheet registration nips 108. The registration controller 122 can comprise any conventional logic/memory unit (computerized device) capable of performing comparisons, storing values, storing and executing logical routines, etc. The controller 122 comprises a computerized device that includes computer-readable storage media that contains instructions that are executed by a computer processor to perform the various functions described herein. Such controllers are widely available from computer manufactures, such as Intel Corporation, Santa Clara, Calif., USA, etc. Note that, in some embodiments, the alignment sensors 120 and the registration controller 122 could be combined into a single unit.

The media sheet registration nips 108 and alignment sensors 120 according to embodiments herein are shown in greater detail in FIGS. 2-6 and measure the position of the media sheet 200 when it arrives at the registration system.

Figure 2:
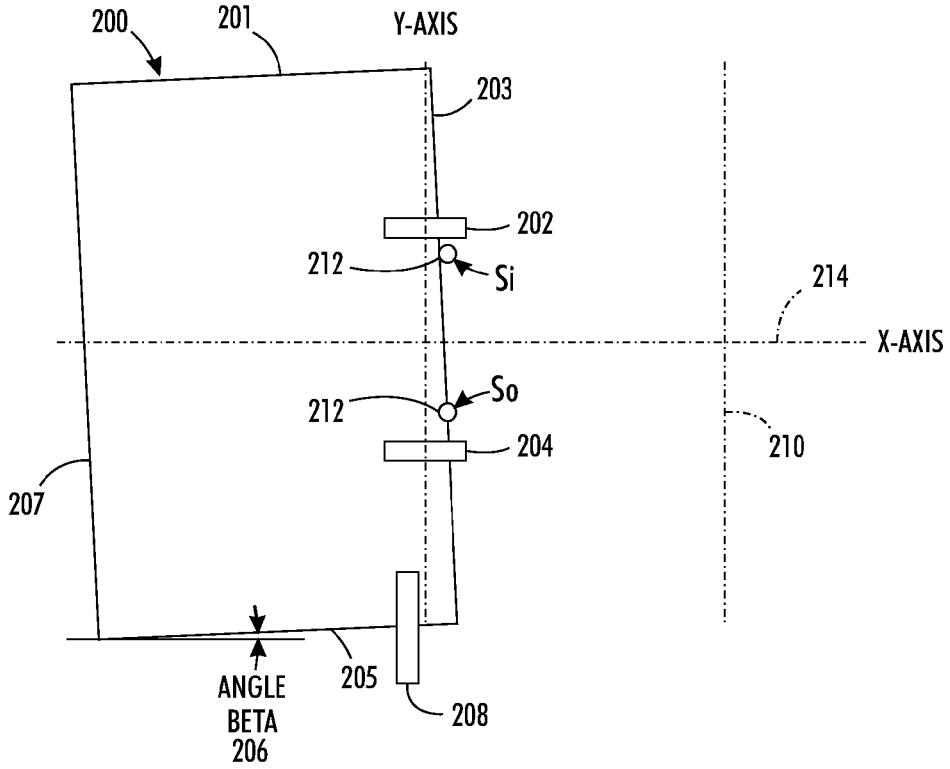
FIG. 2 PRIOR ART
FIG. 2 is a schematic top-view representation of a portion of a media path according to embodiments herein.

The media sheet 200 can be any shape (circular, rectangular, a parallelogram, triangular, etc.) and is generally rectangular and includes: a front side and a backside (one of which is shown in FIG. 2); two lateral sides 201, 205; a leading edge 203; and a trailing edge 207. The lateral sides 201, 205, the leading edge 203, and the trailing edge 207 form the borders of the front side in the back side. Note that, for clarity, the numbering of the sides of the media sheet 200 is omitted in the remaining drawings.

The processing direction is shown as item 214 and the media sheet is intended to move directly along this X-axis. Any deviation from the processing direction 214 is identified as the angle beta 206. The processing direction 214 is perpendicular to the alignment of the alignment devices 202, 204 which lie on the Y-axis.

Lateral, process and skew are measured with a plurality of sensors 212. For example, sensors Si and So comprise single point sensors that measure the time of arrival of the leading edge of the media sheet 200. The average time of arrival ((Si+So)/2) is used for process direction correction. For example, the difference in time of arrival (at Si and So) can be multiplied by the sheet velocity and divided by the sensor spacing as a measurement of the sheet angle beta 206. The lateral sensor S-lat 208 is positioned perpendicular to the processing direction 214 and measures the sheet's 200 lateral edge position.

The angle of the sheet 200 is adjusted by unequal movement of the alignment devices (moving devices) 202, 204 (corresponding to the drive nips 108, discussed above) and the correction is performed so that the sheet can enter the image transfer location 210 without skew/misalignment. The process and lateral positions of the sheet are adjusted by simultaneous movement of the alignment moving devices in the respective process and lateral direction. The alignment devices 202, 204 can comprise any apparatus that has the ability to move the media sheet 200 and can include, for example, drive nips comprising opposing rollers, belts, air movement devices, etc. The alignment devices 202, 204 move the media sheet 200 in the processing direction 214 of the media path 130. The use of an alignment device is optional. Alignment devices are the conventional method to achieving alignment between sheet and image. Alignment devices are capable of providing movement in one or more degrees of freedom to correct the sheet alignment with the associated measurement direction (process and/or lateral and/or skew).

At least two elongated sensors 222, 232 (corresponding to sensors 120, mentioned above) are positioned adjacent the alignment devices 202, 204 within the media path 130. The elongated sensors 222, 232 are positioned diagonally relative to the processing direction 214 of the media path 130. As used herein, the terms diagonal and diagonally refer to angles that are not perpendicular and not parallel to the line formed by the processing direction 214. Therefore any line that forms an angle is between 1° and 89° with respect to line 214 is considered to be diagonal to the processing direction 214. Therefore, for example, sensors positioned at 30°, 45°, 60°, etc., would be considered diagonal.

The elongated sensors discussed herein each comprise an array of light sensitive pixels. Such sensors are commonly available and are not discussed in detail herein. For example, one useful contact image sensor is model IA6008-FA30A manufactured by Rohm Co. Ltd, Kyoto, Japan. The sensors can be any size that is appropriate given the specific application (5 inches, 8.5 inches, 10 inches, etc). Further, the sensors can have any appropriate resolution (e.g., 400 pixels/inch, 600 pixels/inch, 800 pixels/inch, etc.).

The elongated sensors are positioned, relative to the media path 130, such that the elongated sensors simultaneously detect one of the lateral sides and at least one of the leading edge or the trailing edge of the media sheet 200. The elongated sensors are positioned at a diagonal angle with respect to the media path 130 and the processing direction 214. In other words, the elongated sensors are at an angle other than parallel to and other than perpendicular to the sheet processing direction 214.

The elongated sensors can be positioned at a number of different locations with respect to the media path 130 so long as the sensors are not perpendicular or parallel to the media path 130 (are diagonal to the media path 130 and the process direction 214).

Figure 3:
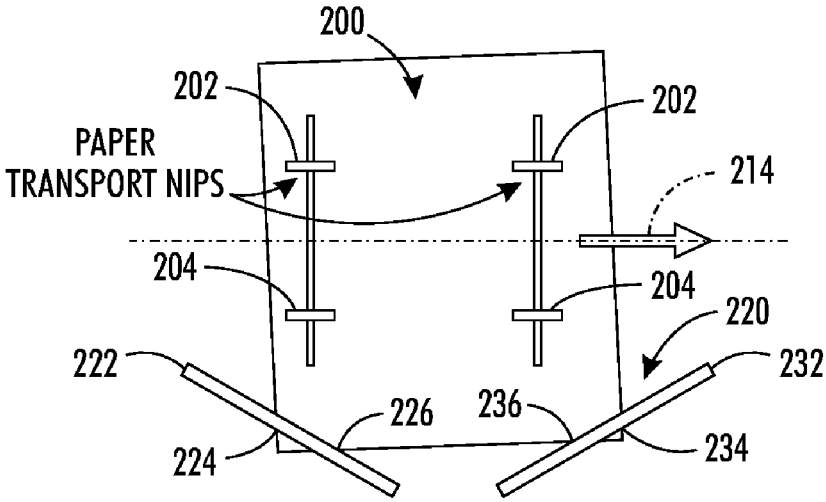
FIG. 3 is a schematic top-view representation of a portion of a media path according to embodiments herein.

For example, in FIG. 3, one of the elongated sensors 222 crosses the trailing edge and a first lateral side of the sheet of media 200. The other elongated sensor 232 in FIG. 3 crosses the leading edge and the same first lateral side of the sheet of media 200. In the different example shown in FIG. 4, elongated sensor 232 is the same as in FIG. 3; however, a different elongated sensor 242 crosses the leading edge and crosses a second lateral side of the media sheet 200. In another example shown in FIG. 5, elongated sensor 232 is the same as in FIGS. 3 and 4; however, a different elongated sensor 252 crosses the trailing edge and crosses the second lateral side of the media sheet 200.

Each of the elongated sensors simultaneously identifies a location of one of the lateral sides of the media sheet 200, and either the leading edge or the trailing edge of the media sheet 200. For example, elongated sensor 222 identifies the lateral side edge measure 226 and the trailing edge measure 224. Similarly, elongated sensor 232 identifies the lateral side edge measure 236 and the leading edge measure 234. Elongated sensor 242 identifies the lateral side edge measure 246 and the leading edge measure 244 and elongated sensor 252 identifies the lateral side edge measure 256 and the trailing edge measure 254.

Figure 4:
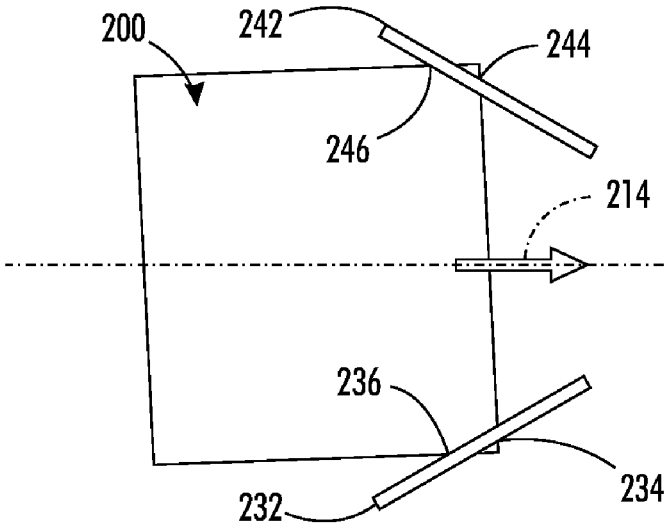
FIG. 4 is a schematic top-view representation of a portion of a media path according to embodiments herein.
Figure 5:
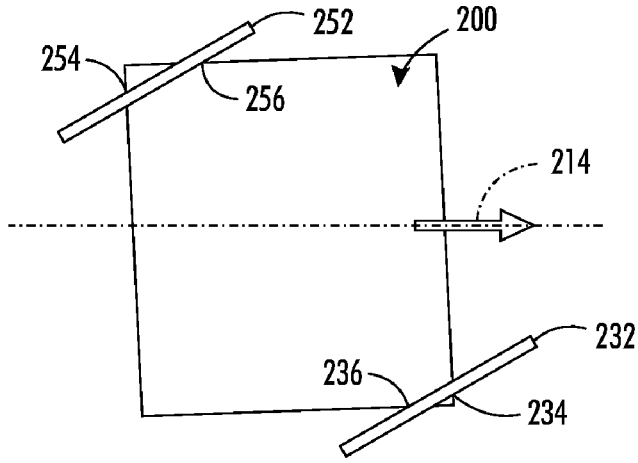
FIG. 5 is a schematic top-view representation of a portion of a media path according to embodiments herein.

Thus, each combination of elongated sensors illustrated in FIGS. 3-5 simultaneously outputs at least two lateral measures of locations of the lateral sides of the media sheet 200 (each sensor outputs one position of one lateral side of the media sheet 200 and the two combined sensors output two lateral measures). Also, each combination of elongated sensors simultaneously outputs at least one leading edge measure of a position of the leading edge of the media sheet 200 and/or at least one trailing edge measure of a position of the trailing edge of the media sheet 200 (each of the sensors detects either the leading edge or the trailing edge and the two combined sensors output one or both measures). For example, in FIG. 3, the combination of elongated sensors 222 and 232 outputs two lateral side edge measures 226, 236, a trailing edge measurement 224, and a leading edge measure 234. Skew can be determined from the difference of the two lateral measurements. In addition, lateral position measurement (for lateral alignment) is measured by either sensor or a weighted average. Process position (for process alignment) is measured by sensor 234 or 224. The choice depends on whether lead edge or trail edge alignment is to be achieved. Similarly, in FIG. 4, the combination of elongated sensors 242 and 232 outputs two lateral side edge measures 246, 236, and two leading edge measures, 244, 234. Skew can be determined from the difference of the two lead edge measurements. Process and lateral measurement can use either sensor or a weighted average.

Also, in FIG. 5, the combination of elongated sensors 252 and 232 outputs two lateral side edge measures 256, 236, a trailing edge measurement 254, and a leading edge measure 234. Process and lateral measurement can be measured from either sensor. However skew is more complicated since sheet size affects a skew measurement that is calculated from a difference of lateral or process measurements. If sheet size (ether width or length) is known, (i.e. from an external input) then a skew measurement (from lateral or process) can be obtained. Alternately, if the aspect ratio (length/width) is known, then a skew measurement can also be obtained.

The registration controller 122 utilizes at least three simultaneous measures (comprising at least one lateral measures; and at least one leading edge measure and/or at least one trailing edge measure) to determine the skew and position (lateral and process) of the media sheet 200. For example, in FIG. 3, the embodiments herein can calculate the skew and position of the media sheet 200 using the leading edge measure 234, the lateral side edge measure 236 and the other lateral side edge measure 226. From the lateral side edge measures, the skew of the sheet is determined. The sheet is considered skewed if the two lateral side measures are not the same distance from any line that is parallel to the processing direction 214. Therefore, if the processing direction 214 also represents the centerline of the media path 130 the sheet would be considered skewed if any the pairs of lateral side edge measures 226, 236, 246, 256 were a different distance from the centerline 214. Similarly, the lateral side edge measures could be compared to an inboard or outboard line of the media path that is parallel to the centerline 214 to determine skew. The lateral position of the sheet with respect to the center line 214 (or any line parallel thereto) can also be determined using the same measures. The sensors also directly give the positions of the leading and trailing edges of the sheet through measures 224, 234, 244, and 254. In FIG. 4, skew can be determined from the difference of the two lead edge measurements. Process and lateral measurements can use either sensor or a weighted average.

In FIG. 5, process and lateral can be measured from either sensor. However skew is more complicated since sheet size affects a skew measurement that is calculated from a difference of lateral or process measurements. If sheet size (ether width or length) is known, (i.e. from an external input) then a skew measurement (from lateral or process) can be obtained. Alternately, if the aspect ratio (length/width) is known, then a skew measurement can also be obtained.

Figure 6:
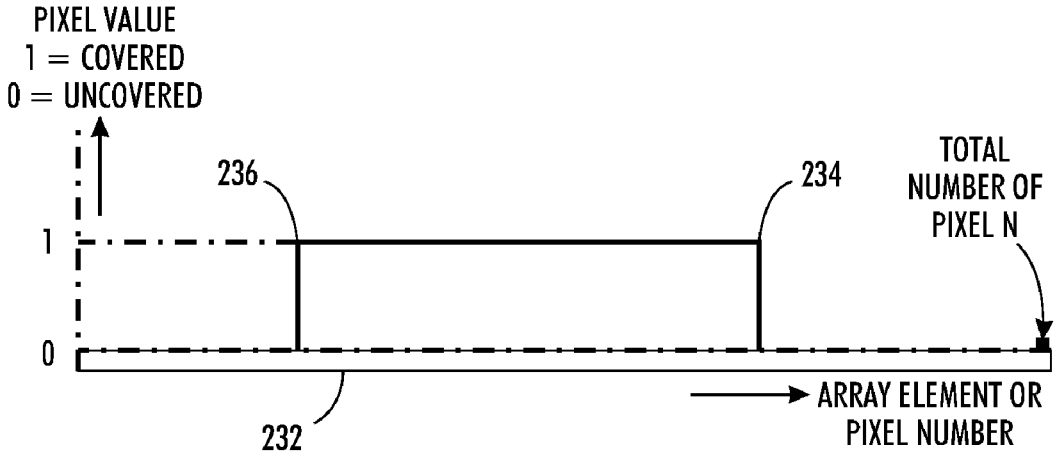
FIG. 6 is a schematic side-view representation of an array sensor according to embodiments herein.

More specifically, as illustrated in FIG. 6, the embodiments herein can calculate the position of the side edge measure and the leading or trailing edge measure using just one of the elongated sensors. In FIG. 6, the sensor is sensor 232. The sensors detect differences in light intensity (using pixels) to establish where the edges of the sheet are positioned. In the example shown in FIG. 6, lateral side edge measure 236 occurs at pixel number i and the leading edge measure 234 occurs at pixel j. The locations of these pixels (i and j) provides a certain distance measurement, allowing the registration controller 122 to calculate the locations of the side edge and the leading or trailing edge. Array signal processing can determine the value of i and j, yielding a position measurements of the side and lead (or trail) edge with any single array sensor. The two different lateral side edge measures can be compared to a known location (relative to a known inboard position, outboard position, or centerline position) to determine the amount of skew of the sheet. Therefore, the embodiments herein allow the skew, lateral position and leading and/or trailing edge position to be known through the use of only two sensors, which produces substantial cost savings when compared to conventional structures that would need to utilize more than two sensors to obtain the same amount of information.

Similarly, the embodiments herein can use one of the trailing edge measures 224 or 254 with two of the side edge measures 226, 236, 246, 256 to determine the skew and position of the media sheet 200. Alternatively, the embodiments herein can use one of the leading an edge measures 234 or 244 with two of the side edge measures 226, 236, 246, 256 to determine the skew and position of the media sheet 200. Skew can be determined from the difference of the two lead edge measurements. Process and lateral measurements can use either sensor or a weighted average.

Figure 7:
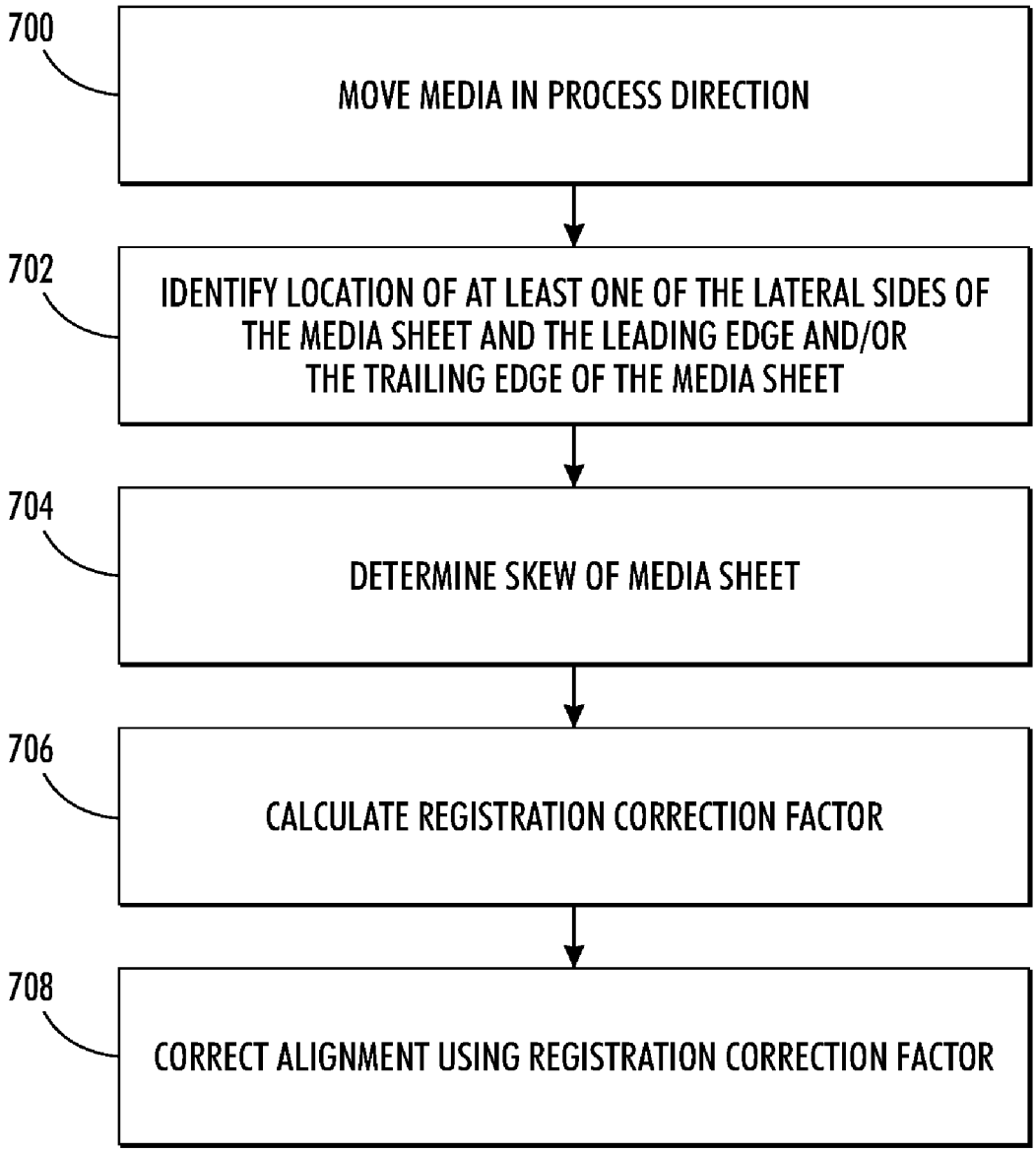
FIG. 7 is a flow diagram according to embodiments herein.

Once the skew and position of the media sheet 200 is determined, the registration controller 122 calculates a registration correction factor based upon the skew and position and alters the actions of the alignment devices 202, 204 based on the correction factor to correct the skew and position Embodiments herein also comprise method embodiments, as shown in flowchart form in FIG. 7. The method shown in item 700 in FIG. 7 moves the media sheet along the media path 130 in the processing direction using moving devices within the media path. The method uses at least two elongated sensors within the media path positioned diagonally relative to the processing direction to simultaneously identify a location of at least one of the lateral sides of the media sheet and the leading edge and/or the trailing edge of the media sheet in item 702. Again, the combination of the elongated sensors simultaneously outputs at least two lateral measures of locations of the lateral sides of the media sheet, and outputs at least one leading edge measure of a position of the leading edge of the media sheet and/or at least one trailing edge measure of a position of the trailing edge of the media sheet.

Utilizing the lateral measures and at least one of the leading edge measure and the trailing edge measure, the registration controller determines the skew and position of the media sheet in item 704. The registration controller also calculates the registration correction factor in item 706 based upon the skew and position, and alters actions of the moving devices based on the correction factor to correct the skew and position in item 708.

Therefore, embodiments herein provide a device and method used in a sheet transport or registration system that uses two array sensors to measure the position of a sheet in three degrees of freedom (process, lateral and skew, x, y, θ). The embodiments herein use any set of two array sensors to simultaneously measure the position of three edges portions of a sheet. The shared edge will yield the sheet angle (skew) and sheet edge (x or y) coordinate, the opposite edges will yield the sheet edge (y or x) coordinate in two distinct places.

Two cases exist. In the case of opposite edges being leading and trailing edges, this enables both side 1 and side 2 registration in duplex systems. In the case of opposite edges being inboard and outboard edges, this enables true center registration By using a set of two array sensors to measure the position of 4 edges of a sheet. The side edges on opposite sides will yield skew (with some error due to cut tolerances) and the lead edge and/or trail edge measurements can be used for lead edge and trail edge registration. Therefore, the embodiments herein allow the skew, lateral position and leading and/or trailing edge position to be known through the use of only two sensors, which produces substantial cost savings when compared to conventional structures that would need to utilize more than two sensors to obtain the same amount of information.

The term "printer" or printing apparatus as used herein encompasses any apparatus, such as a digital copier, bookmaking machine, facsimile machine, multi-function machine, etc. which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The following claims can encompass embodiments that print in monochrome or color or handle color image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus comprising:

a media path comprising moving devices that move a media sheet in a processing direction;

two elongated sensors within said media path positioned diagonally relative to said processing direction, said media sheet comprising two lateral sides, a leading edge, and a trailing edge; and a registration controller operatively connected to said media path and to said two elongated sensors, each of said two elongated sensors simultaneously identifying:

a location of one of said lateral sides of said media sheet, such that a combination of said two elongated sensors simultaneously outputs two lateral measures of locations of said lateral sides of said media sheet; and at least one measure of said leading edge or at least one measure of said trailing edge of said media sheet, such that said combination of said two elongated sensors simultaneously outputs at least one leading edge measure of a position of said leading edge of said media sheet or at least one trailing edge measure of a position of said trailing edge of said media sheet, and said registration controller utilizing said two lateral measures and said at least one leading edge measure or said at least one trailing edge measure to determine a skew and a position of said media sheet, and said registration controller calculating a registration correction factor based upon said skew and altering actions of said moving devices based on said correction factor to correct said skew.

2. The apparatus according to claim 1, said two elongated sensors being positioned, relative to said media path, such that said two elongated sensors simultaneously detect one of said lateral sides and one of said leading edge and said trailing edge of said media sheet.

3. The apparatus according to claim 1, said two elongated sensors being positioned other than parallel to said processing direction and other than perpendicular to said processing direction.

4. The apparatus according to claim 1, said two elongated sensors each comprising an array of light sensitive pixels.

5. The apparatus according to claim 1, said moving devices comprising at least one of rollers, belts, and air pressure devices.

6. A printing apparatus comprising:

a media path comprising moving devices that move a media sheet in a processing direction;

two elongated sensors within said media path positioned diagonally relative to said processing direction, said media sheet comprising two lateral sides, a leading edge, and a trailing edge;

a marking device positioned within said media path, said marking device printing markings on said media sheet; and a registration controller operatively connected to said media path and to said two elongated sensors, each of said two elongated sensors simultaneously identifying:

a location of one of said lateral sides of said media sheet, such that a combination of said two elongated sensors simultaneously outputs two lateral measures of locations of said lateral sides of said media sheet; and a measure of said leading edge or at least one measure of said trailing edge of said media sheet, such that said combination of said two elongated sensors simultaneously outputs at least one leading edge measure of a position of said leading edge of said media sheet or at least one trailing edge measure of a position of said trailing edge of said media sheet, said registration controller utilizing said two lateral measures and said at least one leading edge measure or said at least one trailing edge measure to determine a skew and a position of said media sheet, and said registration controller calculating a registration correction factor based upon said skew and altering actions of said moving devices based on said correction factor to correct said skew.

7. The printing apparatus according to claim 6, said two elongated sensors being positioned other than parallel to said processing direction and other than perpendicular to said processing direction.

8. The printing apparatus according to claim 6, said two elongated sensors each comprising an array of light sensitive pixels.

9. The printing apparatus according to claim 6, said moving devices comprising at least one of rollers, belts, and air pressure devices.

10. A printing apparatus comprising:

a media path comprising alignment devices that move a media sheet in a processing direction;

two elongated sensors adjacent said alignment devices within said media path, said two elongated sensors being positioned diagonally relative to said processing direction, said media sheet comprising two lateral sides, a leading edge, and a trailing edge;

a marking device positioned adjacent said alignment devices within said media path, said marking device printing markings on said media sheet; and a registration controller operatively connected to said media path and to said two elongated sensors, each of said two elongated sensors simultaneously identifying:

a location of one of said lateral sides of said media sheet, such that a combination of said two elongated sensors simultaneously outputs two lateral measures of locations of said lateral sides of said media sheet; and a measure of said leading edge or at least one measure of said trailing edge of said media sheet, such that said combination of said two elongated sensors simultaneously outputs at least one leading edge measure of a position of said leading edge of said media sheet or at least one trailing edge measure of a position of said trailing edge of said media sheet, said registration controller utilizing at least three simultaneous measures comprising said two lateral measures and said at least one leading edge measure or said at least one trailing edge measure to determine a skew and a position of said media sheet, and said registration controller calculating a registration correction factor based upon said skew and altering actions of said alignment devices based on said correction factor to correct said skew.

11. The printing apparatus according to claim 10, said two elongated sensors being positioned, relative to said media path, such that said two elongated sensors simultaneously detect one of said lateral sides and one of said leading edge and said trailing edge of said media sheet.

12. The printing apparatus according to claim 10, said two elongated sensors being positioned other than parallel to said processing direction and other than perpendicular to said processing direction.

13. The printing apparatus according to claim 10, said two elongated sensors each comprising an array of light sensitive pixels.

14. The printing apparatus according to claim 10, said printing apparatus comprising at least one of an electrostatographic and a xerographic machine.

15. A method comprising:

moving a media sheet along a media path in a processing direction using moving devices within said media path, said media sheet comprising two lateral sides, a leading edge, and a trailing edge;

using two elongated sensors within said media path positioned diagonally relative to said processing direction to simultaneously identify:

a location of said lateral sides of said media sheet, such that a combination of said two elongated sensors simultaneously outputs two lateral measures of locations of said lateral sides of said media sheet; and at least one measure of said leading edge or at least one measure of said trailing edge of said media sheet, such that said combination of said two elongated sensors simultaneously outputs at least one leading edge measure of a position of said leading edge of said media sheet or at least one trailing edge measure of a position of said trailing edge of said media sheet, while outputting said two lateral measures of locations of said lateral sides of said media sheet;

utilizing said two lateral measures and said at least one leading edge measure or said at least one trailing edge measure to determine a skew and a position of said media sheet using a registration controller;

calculating a registration correction factor based upon said skew using said registration controller; and altering actions of said moving devices using said registration controller based on said correction factor to correct said skew.

16. The method according to claim 15, each of said two elongated sensors simultaneously detecting one of said lateral sides and one of said leading edge and said trailing edge of said media sheet.

17. The method according to claim 15, said two elongated sensors being positioned other than parallel to said processing direction and other than perpendicular to said processing direction.

18. The method according to claim 15, said two elongated sensors each comprising an array of light sensitive pixels.

19. The method according to claim 15, said moving devices comprising at least one of rollers, belts, and air pressure devices.

* * * * *